US010179334B2

(12) United States Patent
Driscoll et al.

(10) Patent No.: US 10,179,334 B2
(45) Date of Patent: Jan. 15, 2019

(54) UNIVERSAL PIPETTE STAND

(71) Applicant: Heathrow Scientific LLC, Vernon Hills, IL (US)

(72) Inventors: Timothy G. Driscoll, Burlington, WI (US); Gary Dean Kamees, Gurnee, OH (US)

(73) Assignee: HEATHROW SCIENTIFIC LLC, Vernon Hills, IL (US)

( * ) Notice: Subject to any disclaimer, the term of this patent is extended or adjusted under 35 U.S.C. 154(b) by 9 days.

(21) Appl. No.: 15/224,210

(22) Filed: Jul. 29, 2016

(65) Prior Publication Data

US 2018/0029040 A1 Feb. 1, 2018

(51) Int. Cl.
*B01L 9/06* (2006.01)
*B01L 9/00* (2006.01)

(52) U.S. Cl.
CPC ..... *B01L 9/54* (2013.01); *B01L 2200/022* (2013.01); *B01L 2200/023* (2013.01); *B01L 2200/025* (2013.01); *B01L 2200/087* (2013.01); *B01L 2300/0609* (2013.01)

(58) Field of Classification Search
CPC .. B01L 9/54; B01L 9/543; B01L 9/547; B01L 9/06; B01L 9/065
See application file for complete search history.

(56) References Cited

U.S. PATENT DOCUMENTS 652,257 A 6/1900 Folger
1,980,930 A 3/1932 Reyniers
1,914,371 A * 6/1933 Hutt ..... B25H 3/04 211/70.6
2,189,989 A 2/1940 Lichtman
2,376,955 A 5/1945 Ball
2,429,305 A * 10/1947 Barnes ..... B01L 9/06 211/69
2,512,622 A 6/1950 Fish
3,116,730 A 1/1964 Tingley
3,625,485 A 12/1971 Adler
3,918,920 A 11/1975 Barber
4,534,471 A 8/1985 Zahn et al.
4,688,685 A 8/1987 Brace
4,944,924 A 7/1990 Mawhirt et al.
D311,565 S 10/1990 Buri et al.
(Continued)

FOREIGN PATENT DOCUMENTS

CN 203124011 8/2013
CN 204122157 1/2015
(Continued)

OTHER PUBLICATIONS

EP17177638.8 Extended European Search Report dated Oct. 13, 2017 (8 pages).

*Primary Examiner* — Paul S Hyun
(74) *Attorney, Agent, or Firm* — Michael Best & Friedrich LLP

(57) ABSTRACT

The present invention includes a pipette stand having a base, a trunk extending from the base, and a holding assembly coupled to the trunk. The holding assembly forms one or more apertures configured to receive at least a portion of a pipette therein, and the one or more apertures define a first width. The pipette stand also includes an insert removably couplable to the holding assembly and configured to modify the first width.

15 Claims, 3 Drawing Sheets

(56) References Cited

U.S. PATENT DOCUMENTS

| | | | | |
|---|---|---|---|---|
| 5,137,693 | A | 8/1992 | Mawhirt | |
| 5,378,433 | A | 1/1995 | Duckett et al. | |
| 5,417,334 | A * | 5/1995 | Wu | A63B 55/50 206/315.2 |
| D375,023 | S * | 10/1996 | Cohen | D6/680 |
| D394,575 | S | 5/1998 | Mikloczak et al. | |
| 5,772,050 | A | 6/1998 | Shih | |
| 5,785,927 | A * | 7/1998 | Scott | B01J 19/0046 210/323.2 |
| 5,961,927 | A | 10/1999 | Isaacs | |
| 5,985,219 | A | 11/1999 | Lind | |
| D425,255 | S * | 5/2000 | Chen | D28/73 |
| 6,083,462 | A | 7/2000 | Ikonen et al. | |
| 6,308,838 | B1 | 10/2001 | Endean | |
| 6,543,100 | B1 | 4/2003 | Finley et al. | |
| D512,282 | S | 12/2005 | Martin | |
| 7,000,785 | B2 | 2/2006 | Jafari et al. | |
| D519,644 | S | 4/2006 | Jankowski et al. | |
| 7,025,934 | B2 * | 4/2006 | Zimmermann | G01N 1/31 118/423 |
| D524,448 | S | 7/2006 | Telimaa et al. | |
| D544,609 | S | 6/2007 | Bluon | |
| 7,282,182 | B2 | 10/2007 | Dale et al. | |
| 7,587,952 | B2 | 9/2009 | Dale et al. | |
| 7,624,868 | B2 | 12/2009 | Booker et al. | |
| 7,988,933 | B2 | 8/2011 | Vijay et al. | |
| 8,074,814 | B2 | 12/2011 | Morris et al. | |
| 8,186,524 | B2 | 5/2012 | Siahpush | |
| D662,603 | S | 6/2012 | Greenizen | |
| 8,342,341 | B2 | 1/2013 | Cass et al. | |
| 8,367,024 | B2 | 2/2013 | Itoh | |
| 8,574,515 | B2 | 11/2013 | Ellis et al. | |
| 8,590,715 | B2 | 11/2013 | Gray | |
| 8,636,259 | B2 | 1/2014 | Manke et al. | |
| D705,444 | S | 5/2014 | D'Argy et al. | |
| 8,727,140 | B2 | 5/2014 | Verson | |
| D709,210 | S | 7/2014 | D'Argy et al. | |
| D754,872 | S | 4/2016 | Li et al. | |
| D763,464 | S | 8/2016 | Li et al. | |
| 2002/0108917 | A1 | 8/2002 | Maruyama | |
| 2003/0106382 | A1 | 6/2003 | Shukla et al. | |
| 2003/0161764 | A1 | 8/2003 | Itoh | |
| 2003/0215370 | A1 | 11/2003 | Itoh | |
| 2005/0180895 | A1 * | 8/2005 | Itoh | B01L 9/06 422/400 |
| 2005/0265900 | A1 | 12/2005 | Gard et al. | |
| 2008/0290054 | A1 | 11/2008 | Cass et al. | |
| 2011/0061499 | A1 * | 3/2011 | Franklin | B25B 13/463 81/60 |
| 2013/0095508 | A1 | 4/2013 | Campitelli et al. | |
| 2015/0108076 | A1 | 4/2015 | Branch et al. | |

FOREIGN PATENT DOCUMENTS

| | | |
|---|---|---|
| CN | 204544239 | 8/2015 |
| CN | 205146277 | 4/2016 |
| EP | 2098296 | 9/2009 |
| JP | 2010078483 | 4/2010 |
| JP | 2010201396 | 9/2010 |

* cited by examiner

UNIVERSAL PIPETTE STAND

BACKGROUND

The present disclosure relates to a pipette stand, and more specifically to a pipette stand that is adjustable to store multiple pipettes of different sizes.

In laboratory settings, product flexibility is important to accommodate the various requirements of different experiments. Specifically, the ability to place items, such as pipettes, in readily accessible positions on the work surface can aid the scientist or technician in conducting an experiment. In addition to easy accessibility, it is important that the storage capabilities of a pipette stand be easily modified to accommodate different types and quantities of pipettes that may be necessary for different types of experiments.

SUMMARY

In one aspect, a pipette stand having a base, a trunk extending from the base, and a holding assembly coupled to the trunk. The holding assembly forms one or more apertures configured to receive at least a portion of a pipette therein, and the one or more apertures define a first width. The pipette stand also includes an insert removably couplable to the holding assembly and configured to modify the first width.

In another aspect, a pipette stand having a base, a trunk extending from the base, and a holding assembly coupled to the trunk opposite the base. Where the holding assembly forms one or more apertures configured to receive at least a portion of a pipette therein, and where each aperture is adjustable between a first configuration, where the opening defines a first width, and a second configuration, where the opening defines a second width different than the first width.

In still another aspect, a pipette stand includes a base, a trunk extending from the base, and a holding assembly coupled to the trunk opposite the base. Where the holding assembly includes a stem, a first set of petals extending radially outwardly from the stem, where the first set of petals each define an aperture therein, a second set of petals extending radially outwardly from the stem and axially offset from the first set of petals, where the second set of petals each define an aperture therein, and where at least one aperture of the first set of petals is axially aligned with at least one aperture of the second set of petals.

Other aspects of the disclosure will become apparent by consideration of the detailed description and accompanying drawings.

DETAILED DESCRIPTION

Before any constructions of the disclosure are explained in detail, it is to be understood that the disclosure is not limited in its application to the details or arrangement of components set forth in the following description or illustrated in the accompanying drawings. The disclosure is capable of supporting other implementations and of being practiced or of being carried out in various ways.

Figure 1:
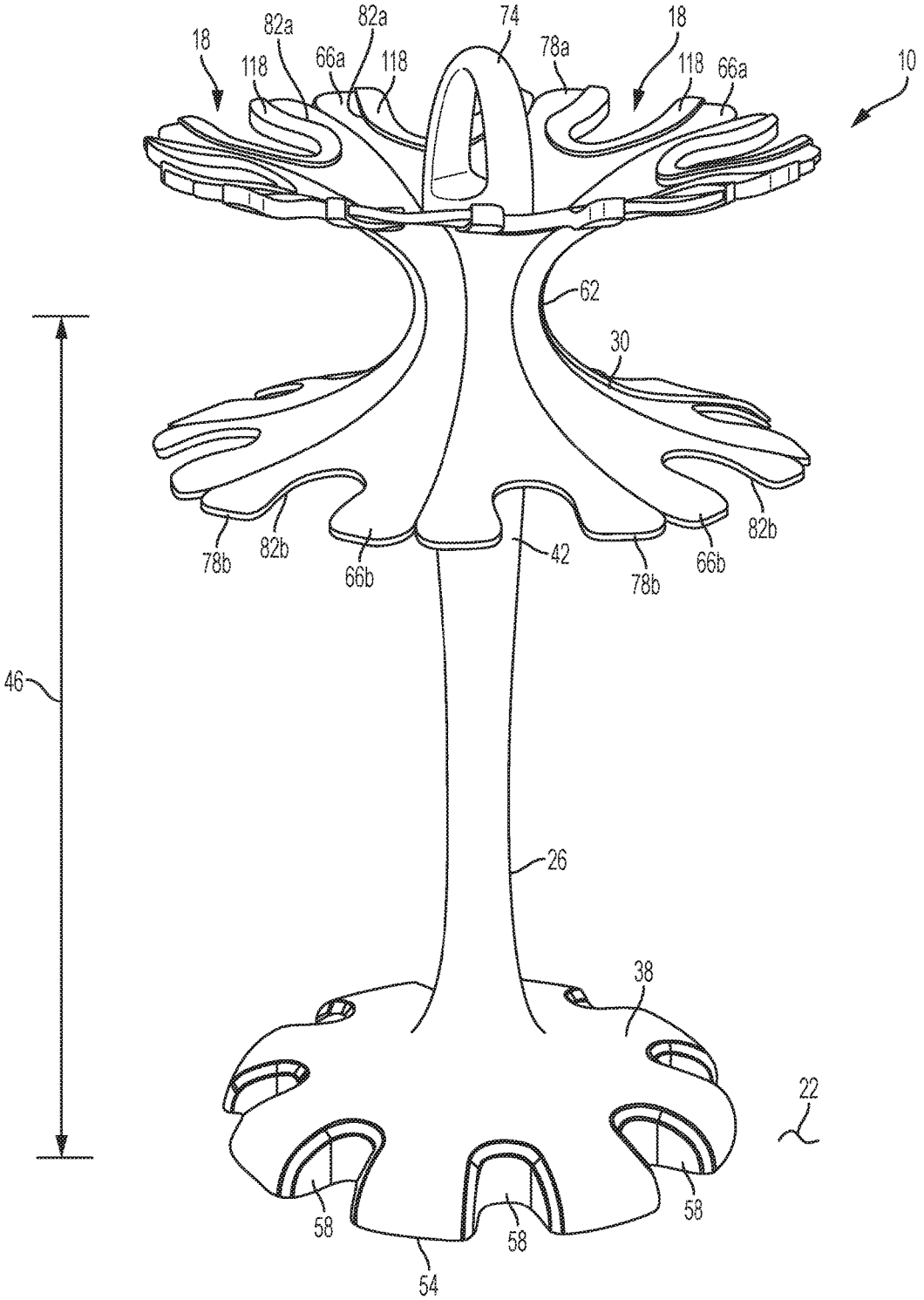
FIG. 1 is a perspective view of a universal pipette stand.

FIG. 1 generally illustrates a universal pipette stand 10 configured to store a plurality of pipettes 14 therein. More specifically, the pipette stand 10 defines a plurality of individual storage positions 18, each of which is independently adjustable in size and shape to accommodate pipettes 14 of different sizes. More specifically, the shape and size of each storage position 18 can be altered to correspond with different pipette designs. Each storage position 18 is configured such that the corresponding pipette 14 is maintained in a substantially vertical orientation above a support surface 22 such as a deck or table, and the pipette can be removed from the stand 10 with a single hand.

Illustrated in FIG. 1, the pipette stand 10 includes a base 38 configured to rest on a support surface 22, a trunk 26 extending vertically from the base 38, and a holding assembly 30 coupled to the trunk 26 opposite the base 38 and defining a plurality of storage positions 18 along the perimeter thereof. In the illustrated construction, the holding assembly 30 is rotatably coupled to the trunk 26, such that the holding assembly 30 may be rotated with respect to the trunk 26 providing the user easy access to each individual storage position 18. In alternative constructions, the holding assembly 30 may be fixedly coupled to the trunk 26. In still other constructions, the holding assembly 30 may be removably coupled to the trunk 26. If removably coupled, the holding assembly 30 may be detached from the trunk 26 and interchanged with alternative holding assemblies (not shown). Still further, the pipette stand 10 may include a plurality of interchangeable holding assemblies (not shown), each of which may be interchangably coupled to the trunk 26 to provide one or more unique storage characteristics (i.e., a different number of storage positions, a greater distance between storage positions, storage positions at different vertical distances from the support surface, different shaped storage positions, and any combination thereof).

Illustrated in FIG. 1, the trunk 26 extends vertically from the base 38 a first length 46 to define a distal end 42. The length 46 is generally larger than the length of the pipette 14 to be stored so that any pipettes positioned in the stand 10 can be stored without having the pipette tip 50 contact the support surface 22. In alternative constructions, the first length 46 of the trunk 26 may be adjustable, so that the distal end 42 and the holding assembly 30 coupled thereto can be repositioned at different heights above the support surface 22.

Illustrated in FIG. 1, the base 38 is enlarged in diameter relative to the trunk 26, producing a substantially planar bottom surface 54. More specifically, the base 38 extends radially outwardly from the trunk 26 producing an outer diameter sufficient to provide the support and stability necessary to maintain the stand 10 in a substantially upright and vertical orientation. In the illustrated construction, the base 38 defines a plurality of notches 58 spaced evenly along the perimeter thereof. Each notch 58 generally aligns axially with a respective storage position 18 (described below) to provide clearance from the base 38 for the tip 50 of a corresponding pipette 14. Although not illustrated, the base 38 of the trunk 26 may include one or more weights embedded therein to lower the center of gravity of the stand 10 and increase the stand's stability. In still other constructions, the bottom surface 54 may include an adhesive and/or textured surface to provide additional stability. In still other constructions, the base 38 may be detachable from the trunk 26. In such constructions, the base 38 may also be interchanged with an alternative base (not shown) having features (e.g., suction cups, adhesive, magnets, Velcro, and the like) designed to maintain the device 10 in a substantially vertical orientation.

Illustrated in FIG. 1, the holding assembly 30 of the pipette stand 10 is substantially hyperboloid in shape and includes a central stem 62, a first set petals 66*a* extending radially outwardly from the stem 62, and a second set of petals 66*b* extending radially outwardly from the stem 62 and axially offset from the first set of petals 66*a*. The holding assembly 30 also includes an arcuate handle 74 extending axially from the stem 62 opposite the trunk 26. During use, the handle 74 is configured to allow the user to grasp and lift the stand 10, including any pipettes stored therein.

Figure 2:
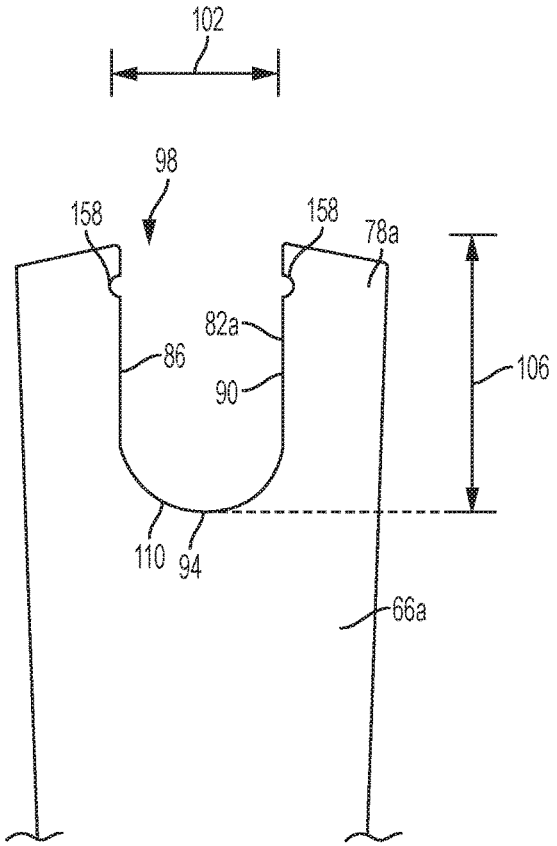
FIG. 2 is a top view of a first petal from the universal pipette stand of FIG. 1.

Each petal from the first set of petals 66*a* is substantially elongated in shape extending radially outwardly and axially upwardly from the stem 62 away from the bottom surface 54 of the base 38 to define a distal end 78*a*. Each petal 66*a* also defines an aperture 82*a* positioned proximate the distal end 78*a* and extending radially inwardly therefrom (FIG. 2). In the illustrated construction, each aperture 82*a* is substantially "U" shaped, open to the distal end 78*a* of the petal 66*a*, and configured to receive at least a portion of a pipette therein. More specifically, each aperture 82*a* is defined by a first substantially linear sidewall 86, a second substantially linear sidewall 90 spaced from and substantially parallel to the first sidewall 86, a curvilinear endwall 94 extending between the sidewalls 86, 90, and an open end 98 opposite the endwall 94. Each aperture 82*a* also defines a width 102, measured between the two sidewalls 86, 90, and a depth 106 measured from the distal end 78 to the radially most inward location on the endwall 94. (See FIG. 2). Still further, the endwall 94 defines a radius 110. In alternative constructions, different shapes, contours, and sizes of apertures 82*a* may be used to correspond with and receive particular shapes, contours, and sizes of pipettes.

Each petal from the second set of petals 66*b* is substantially similar in shape to the petals of the first set of petals 66*a*. More specifically, each petal 66*b* is substantially elongated in shape extending radially outwardly and axially downwardly from the stem 62 toward the bottom surface 54 of the base 38 to define a distal end 78*b*. Each petal 66*b* also defines an aperture 82*b* positioned proximate the distal end 78*b* and extending radially inwardly therefrom. Each aperture 82*b* of the second set of petals 66*b* is identical in size and shape to the apertures 82*a* of the first set of petals 66*a* and therefore will not be described in detail herein. While the apertures 82*b* of the second set of petals 66*b* are identical in size and shape to the apertures 82*a* of the first set of petals 66*a*, the apertures 82*b* may be sized or shaped differently as needed to receive pipettes of various sizes and shapes. Still further, each aperture 82*b* within the second set of petals 66*b* may be shaped differently according to the pipette to be stored therein.

The apertures 82*a*, 82*b* of the first and second sets of petals 66*a*, 66*b* cooperate to at least partially define the storage positions 18 of the pipette stand 10. More specifically, each aperture 82*a* of the first set of petals 66*a* is axially aligned with a corresponding aperture 82*b* of the second set of petals 66*b* to form a pair. Each pair of axially aligned apertures 82*a*, 82*b*, in turn, forms a storage position 18. To store pipettes, the user may position a pipette 14 in the resulting storage positions 18 such that the body 114 of the pipette is supported by the walls of the upper aperture 82*a* while the tip 50 of the pipette 14 hangs down and passes through the lower aperture 82*b*. In some instances, the walls of the lower aperture 82*b* will engage the tip 50 of the pipette 14 for additional stability. Together, the walls of the two apertures 82*a*, 82*b* support the pipette 14 in a substantially vertical orientation.

Figure 3:
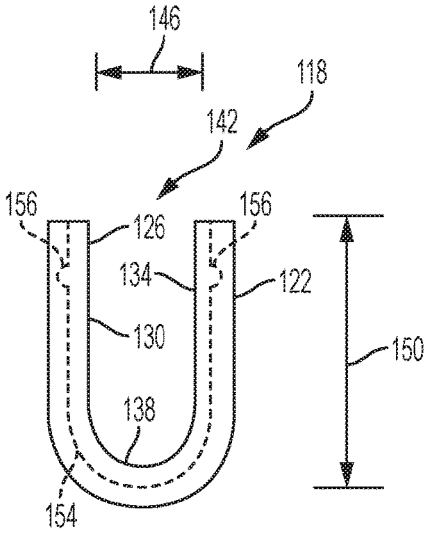
FIG. 3 is a top view of an insert.
Figure 4:
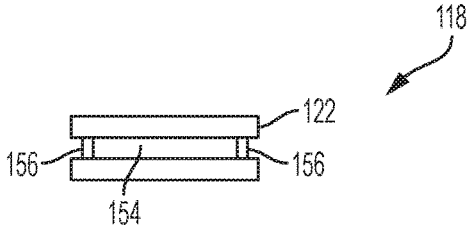
FIG. 4 is an end view of the insert of FIG. 3.

Illustrated in FIGS. 3 and 4, the stand 10 also preferably includes a plurality of inserts 118, each configured to engage with and be removably positioned within a corresponding aperture 82*a*, 82*b* of the holding assembly 30 and configured to alter the size and shape of the apertures 82*a*, 82*b*. Each insert 118 is substantially "U" shaped to mirror the shape of apertures 82*a*, 82*b* and includes an outer contour 122 and an inner contour 126. In the illustrated construction, the outer contour 122 of each insert 118 is sized and shaped to correspond with and be slightly larger than the contour of the corresponding apertures 82*a*, 82*b* (described above). In the illustrated construction, the insert 118 is formed from hard plastic so as not to grip the pipette 14 so firmly as to make it difficult to remove. However, in alternative constructions the insert 118 may be formed from a more resilient material such as rubber when a more secure grip is required.

The inner contour 126 of each insert 118 is substantially "U" shaped and has a first substantially linear sidewall 130, a second substantially linear sidewall 134 spaced a distance from and substantially parallel the first sidewall 130, a curvilinear endwall 138 extending between the sidewalls 130, 134, and an open end 142 opposite the end wall 138. The inner contour 126 also defines a width 146 and a depth 150. The width 146 and the depth 150 of the insert 118 are less than the width 102 and depth 106 of the apertures 82*a*, 82*b*. While the illustrated insert 118 defines an inner contour 126 that is substantially "U" shaped, alternative constructions may include any contour or shape necessary to accommodate various pipette designs. Furthermore, each pipette stand 10 may include a combination of inserts each defining a unique inner contour (not shown) that does not mirror the shape of apertures 82*a*, 82*b*. In such constructions, the various inserts may be mixed and matched to accommodate the specific combination of pipettes used in a particular lab station and the like.

Each insert 118 also defines a groove 154 extending along and open to at least a portion of the outer contour 122. The groove 154 is sized to slidably receive and grip at least a portion of a corresponding petal 66*a*, 66*b* therein. In the illustrated construction, the groove 154 extends along the entire outer contour 122 of the insert 118 and is open on both ends (see FIGS. 3 and 4).

To position an insert 118 within an aperture 82*a*, 82*b*, the user positions the insert 118 such that the endwall 138 of the insert 118 is radially aligned with the open end 98 of the corresponding aperture 82*a*, 82*b*. The user then orients the insert 118 so that the petal 66*a*, 66*b* is axially aligned with the groove 154 of the insert 118. The user positions the insert 118 within the aperture 82*a*, 82*b* by radially introducing the endwall 138 of the insert 118 into the aperture 82*a*, 82*b* via the open end 98, making sure that the first and second sidewalls 86, 90 of the aperture 82*a*, 82*b* are at least partially positioned within and slide along the groove 154. The user continues to advance the insert 118 into the aperture 82*a*, 82*b* until the endwall 94 of the aperture 82*a*, 82*b* is positioned within the groove 154. In some implementations, the insert 118 may include a protrusion 156 or detent within the groove 154 to secure the insert 118 in place. In still other constructions, the walls defining aperture 82*a*, 82*b* may include a corresponding protrusion or detent 158. In either such construction, the user may receive tactile feedback or an audible click signifying that the insert 118 has been properly seated within the aperture 82*a*, 82*b*.

During use of the pipette stand 10, the introduction and removal of inserts 118 into the necessary apertures 82*a*, 82*b* permits each storage position 18 to accommodate pipettes of different sizes. More specifically, the apertures 82*a*, 82*b* of each storage position 18 may be adjusted between a first configuration, where the aperture 82*a*, 82*b* defines a first width and a first depth (i.e., the insert 118 is positioned within the corresponding apertures 82*a*, 82*b*), and a second configuration, where the aperture 82*a*, 82*b* defines a second width and a second depth (i.e., the insert 118 is removed from the corresponding apertures 82*a*, 82*b*). In the illustrated construction, the pipette stand 10 provides eight storage positions 18 (i.e., eight pairs of apertures 82*a*, 82*b*) each of which are independently adjustable to accommodate pipettes of different sizes. However, in alternative constructions more or fewer storage positions 18 may be present.

To use the pipette stand, the user first takes inventory of the number and sizes of pipettes he or she wishes to place in the pipette stand 10. For each pipette much smaller in diameter than the width of the aperture, the user collects a corresponding insert 118 and places it in desired apertures 82*a*. In the illustrated construction, the user need only place inserts 118 in the apertures 82*a* formed in the first set of petals 66*a*. However in alterative constructions, the user may place inserts 118 in apertures formed by the first and second set of petals 66*a*, 66*b*. Once the inserts 118 are in place, the user may place any smaller-sized pipettes in storage positions 18 having inserts 118 (i.e., in the first configuration), and the user may place any larger-sized pipettes in the storage positions 18 not having inserts (i.e., in the second configuration).

After the user has completed his or her experiment, the user may add or remove any inserts 118 necessary to accommodate the next experiment.

Figure 6A:
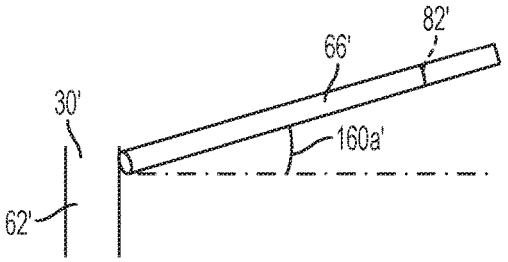
FIGS. 6*a* and 6*b* are side views of a petal from an alternative construction of a universal pipette stand shown in different angular positions.
Figure 6B:
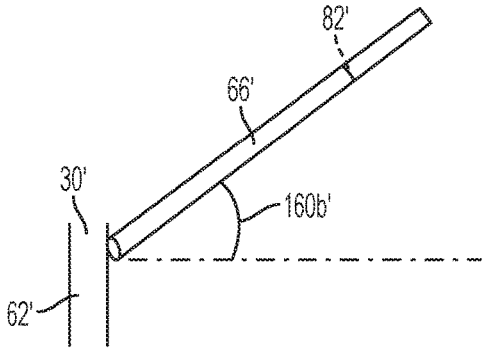
Figure 5:
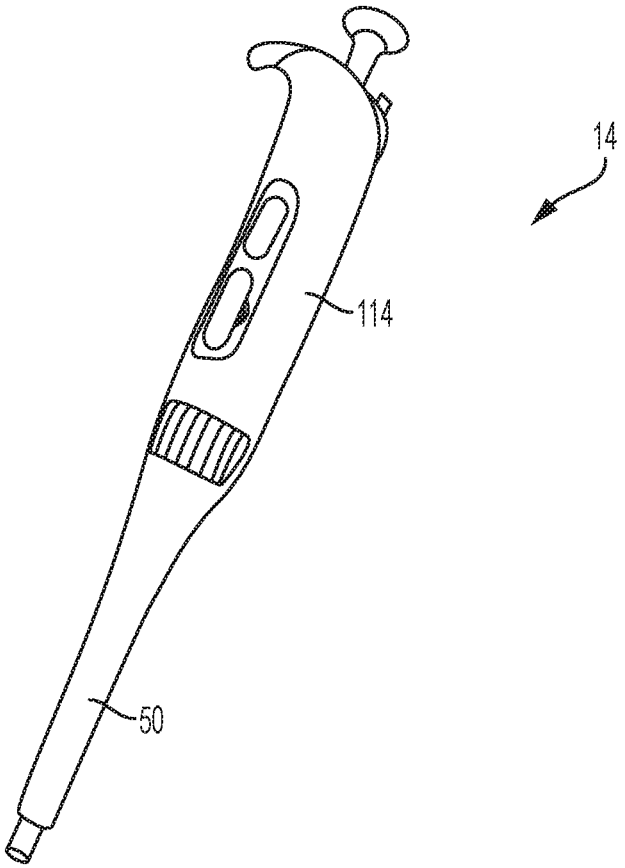
FIG. 5 is a perspective view of a pipette.

FIGS. 6*a* and 6*b* illustrate an alternative construction of the holding assembly 30' having a plurality of angularly adjustable petals 66'. The holding assembly 30' is substantially similar to the holding assembly 30 as illustrated in FIG. 1, and as such, only the differences will be described herein. The holding assembly 30' includes a first set of petals 66' pivotably coupled to the stem 62' and adjustable between a first position (see FIG. 6*a*), where the petal 66' forms a first angle 160*a*' with respect to horizontal, and a second position (see FIG. 6*b*), where the petal 66' forms a second angle 160*b*' with respect to horizontal different than the first angle 160*a*'. Each petal 66' may be maintained in the first or second position by a plurality of detents (not shown) formed into the joints between the petals 66' and the stem 62'. In other instances, each petal 66' may be maintained in the first or second position by the frictional forces present in the joint itself.

During use, the user may adjust the petal angle to accommodate pipettes of different sizes and shapes without having to modify the size or shape of the aperture 82' in which the pipette has been placed. More specifically, the petal angle dictates the relative angle at which the sidewalls 130', 134' of the aperture 82' contact the body 114 of the pipette 14. This, in turn, allows the aperture 82' to maintain different sized pipettes 14 in a substantially upright and vertical orientation without requiring a change in the aperture 82' shape. In the illustrated embodiment, each petal 66' is adjustable independently, however in alternative embodiments, multiple petals 66' may be adjusted together as a group.

What is claimed is:

1. A pipette stand comprising:

a base;

a trunk extending axially from the base;

a holding assembly coupled to the trunk, the holding assembly including a petal extending radially outwardly from the trunk to define an outer perimeter and an aperture configured to receive at least a portion of a pipette therein, and wherein the aperture includes a distal end open to the outer perimeter, and wherein the aperture defines a first width;

an insert having an open end, and wherein the insert is removably couplable to the aperture so that the open end of the insert aligns with the distal end of the aperture;

wherein the insert includes an outer contour, and where the insert defines a groove extending along and open to the outer contour; and wherein the insert includes one of a protrusion or a detent at least partially positioned within the groove.

2. The pipette stand of claim 1, wherein the insert defines a second width that is less than the first width.

3. The pipette stand of claim 1, wherein the holding assembly is rotatably coupled to the trunk.

4. The pipette stand of claim 1, wherein the aperture defines a first depth measured from the distal end to the most radially inward location of the aperture relative to the trunk, wherein the insert defines a second depth measured from the open end of the insert to the most radially inward location of the insert relative to the trunk, and wherein the second depth is less than the first depth.

5. The pipette stand of claim 1, wherein the aperture is among a first set of apertures, the pipette stand further comprising a second set of apertures, and wherein each aperture of the second set of apertures is axially spaced from each aperture of the first set of apertures.

6. The pipette stand of claim 5, wherein at least one aperture of the first set of apertures is axially aligned with at least one aperture of the second set of apertures.

7. The pipette stand of claim 1, wherein the base defines one or more notches therein.

8. The pipette stand of claim 7, wherein at least one notch of the one or more notches is axially aligned with the aperture.

9. The pipette stand of claim 1, wherein the insert defines an inner contour, and wherein the inner contour mirrors the shape of the aperture.

10. The pipette stand of claim 1, wherein the outer contour mirrors the shape of the aperture.

11. The pipette stand of claim 1, wherein the groove is sized to receive at least a portion of the holding assembly therein.

12. The pipette stand of claim 1, wherein the holding assembly is operable in a first configuration, where the insert is positioned within the aperture so the holding assembly is configured to support a pipette of a first size, and a second configuration, where the insert is removed from the aperture so that the holding assembly is configured to support a pipette of a second size different than the first size.

13. The pipette stand of claim 1, wherein the aperture is substantially U-shaped.

14. A pipette stand comprising:

a base;

a trunk extending from the base; and a holding assembly rotatably coupled to the trunk opposite the base, wherein the holding assembly is substantially hyperboloid in shape and includes:

a stem axially aligned with the trunk, a first set of petals extending radially outwardly from the stem to produce a first substantially circular outer perimeter, wherein at least one petal of the first set of petals defines an aperture that is open to the first outer perimeter, a second set of petals extending radially outwardly from the stem axially offset from the first set of petals to produce a second substantially circular outer perimeter, wherein at least one petal of the second set of petals defines an aperture that is open to the second outer perimeter, and wherein at least one aperture of the first set of petals is axially aligned with at least one aperture of the second set of petals.

15. The pipette stand of claim 14, further comprising an insert removably couplable to one of the apertures of the first set of petals and the second set of petals, wherein the insert includes an open end.

* * * * *